United States Patent [19]

Dehn

[11] Patent Number: 4,603,570

[45] Date of Patent: Aug. 5, 1986

[54] UNIVERSAL DEDICATED FIXTURE FOR FRAME STRAIGHTENING RACK

[76] Inventor: Freddie H. Dehn, Box 63, Excelsior Springs, Mo. 64024

[21] Appl. No.: 559,639

[22] Filed: Dec. 12, 1983

[51] Int. Cl.[4] ..... B21D 1/12

[52] U.S. Cl. ..... 72/305; 33/180 AT; 72/705

[58] Field of Search ..... 72/705, 305; 33/180 AT, 33/181 AT

[56] References Cited

U.S. PATENT DOCUMENTS

| | | | |
|---|---|---|---|
| 4,055,061 | 10/1977 | Bayorgeon et al. | 72/705 |
| 4,174,623 | 11/1979 | LeGrand et al. | 72/705 |
| 4,342,154 | 8/1982 | Legrand | 33/180 AT |
| 4,479,305 | 10/1984 | Wendl et al. | 33/180 AT |

*Primary Examiner*—Lowell A. Larson

*Attorney, Agent, or Firm*—Kokjer, Kircher, Bradley, Wharton, Bowman & Johnson

[57] ABSTRACT

A fixture assembly for use in conjunction with a vehicle frame straightening rack. The assembly is adjustable to accommodate any model of vehicle, adjustments being possible in both fore and aft as well as side to side directions and in height. An adjustable clamping fixture is incorporated into the assembly to hold the frame on the straightening rack. In use, the vehicle frame to be straightened is supported on the straightening rack. One side is aligned at the fixturing points provided in the vehicle frame by use of an alignment fixture at one end of an alignment beam. The opposite side is then similarly aligned at the opposing end of the alignment beam with a similar alignment fixture. A ruler is provided on the alignment beams to aid in the precision of placement of the alignment fixtures. Clamping fixtures are then attached and all the fixtures are locked in place. As the frame is then straightened the fixtures remain engaged with the frame and precise alignment is accomplished. After the frame is aligned at the first set of fixturing points, the procedure is repeated as necessary at subsequent fixturing points to provide complete alignment of the vehicle frame.

4 Claims, 8 Drawing Figures

UNIVERSAL DEDICATED FIXTURE FOR FRAME STRAIGHTENING RACK

This invention relates generally to vehicle frame straightening equipment and, more particularly, to a fixture assembly for use in conjunction with a vehicle frame straightening rack.

In recent years, automotive vehicles have been constructed almost entirely with unitized bodies. That is, the entire frame and body of the vehicle are a unit assembly. Such a construction is more economical, lighter weight and can equal or exceed the strength of conventional frames.

The repair of unitized vehicle bodies necessitates the use of frame straightening machines which are designed to pull the damaged vehicle frame into proper alignment. So-called "fixturing holes" are provided in the frames of the vehicles which holes can be utilized for realignment when damage occurs.

Two basic types of fixturing devices have been utilized in conjunction with frame straightening racks. One type of fixture is a so-called "universal" design which can be utilized with any make of car. The universal fixtures are adjustable to some degree but are not designed to actually engage the frame and are not strong enough to permit utilization of a frame straightening machine with the fixtures in place.

Another type of fixturing system is the so-called "dedicated" fixture which is designed to fit a particular model of vehicle. Dedicated fixtures are secured to the frame straightening rack and actually engage the frame of the vehicle. The frame straightening machine can then be utilized to pull the frame while the fixtures maintain alignment.

There are disadvantages with both of the fixturing systems of the prior art. The universal system, while accommodating different vehicle frames, is at best difficult to use because it is not suited for actual engagement with the frame. In many cases, the universal system is completely unsatisfactory for this same reason. The dedicated system provides the best fixturing tool for use in frame straightening, but is highly expensive since different fixtures are required for each model of vehicle.

It is, therefore, a primary object of the present invention to provide a dedicated fixturing system for use in conjunction with a vehicle frame straightening rack which system is also universal in that it is infinitely adjustable to accommodate virtually any mode of vehicle.

It is an important aim of this invention to provide a universal fixturing system for vehicle frame straightening racks which is simple to operate, economical, and strong enough to withstand pulling of the vehicle frame by the frame straightening machine.

As a corollary to the foregoing objects, an important aim of my invention is to provide a universal dedicated fixturing system for use in conjunction with vehicle frame straightening racks which has unlimited adjustment in both the fore and aft direction of the vehicle as well as from side to side.

It is also an important objective of the invention to provide a fixturing system for use in conjunction with vehicle frame straightening racks wherein the fixtures are adjustable in height.

Another aim of the invention is to provide a universal fixturing system for use in conjunction with vehicle frame straightening racks wherein the fixtures can accommodate different size holes in vehicle bodies.

Another one of the objectives of the invention is to provide a fixture assembly for use in conjunction with vehicle frame straightening racks wherein the fixturing block is also designed to provide an adjustable clamping fixture for use in holding the vehicle frame on the straightening rack.

As a corollary to the preceding objective, it is one of the aims of the invention to provide a clamping fixture which is adjustable both fore and aft and transversely of the vehicle frame.

Other objects of the invention will be made clear or become apparent from the following description and claims when read in light of the accompanying drawing, wherein:

Figure 1:
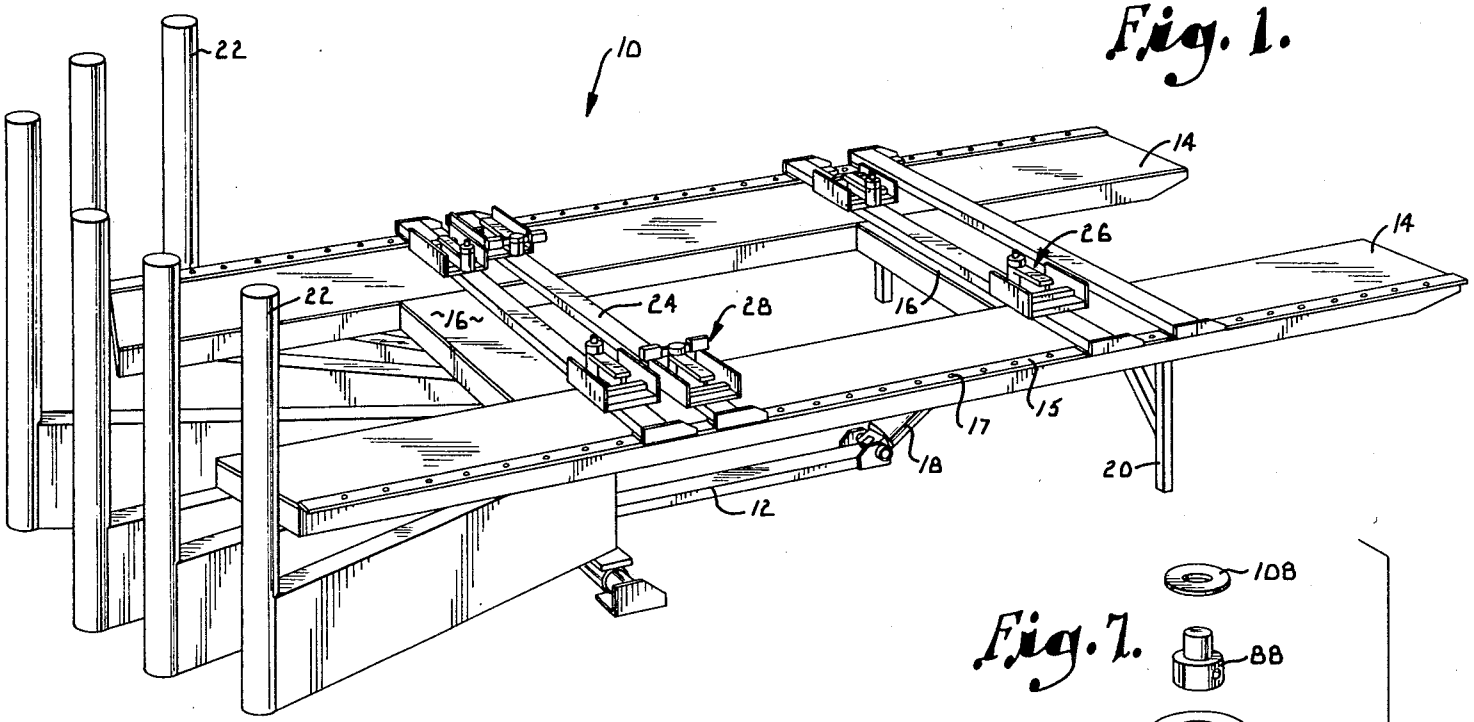
FIG. 1 is a perspective view of a vehicle frame straightening rack utilizing the fixturing system of the present invention.

Referring initially to FIG. 1, a frame straightening rack is designated generally by the numeral 10. Rack 10 includes a base 12 and horizontal spaced-apart gangways 14. Gangways 14 in cooperation with horizontal cross braces 16 present a platform for supporting a vehicle (not shown). A side rail 15 rigid with each gangway 14 has a plurality of apertures 17 spaced along its length.

Cylinder 18 extending from the base to the aforementioned platform provides means for tilting the latter to permit a vehicle to be driven upon it. In this regard, legs 20 can be folded out of the way to accommodate the tilting motion. A plurality of pulling towers 22 are pivotally mounted on base 12 and are movable to different positions surrounding the vehicle supporting platform. It is to be understood that a chain and pulley assembly would be positioned on one or more of the towers 22 for the purpose of straightening a vehicle frame.

The fixturing assembly of the present invention includes a plurality of beams 24 extending transversely to the platform of rack 10 and mounting a plurality of aligning fixtures 26 and clamping fixtures 28.

Referring now to FIGS. 2–5, each beam 24 includes a ruler 30 on its upper horizontal surface and has feet 32 at opposite ends of the beam. Holes 34 in the beam and holes 36 in the feet receive bolts 38 and 40 which are received by holes 17 in rails 15.

Figure 5:
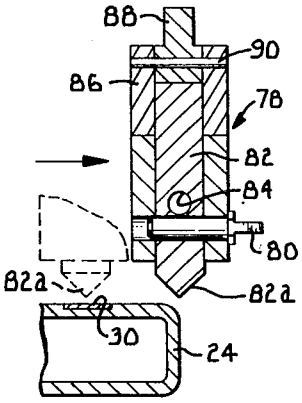
FIG. 5 is a vertical cross-sectional view taken along line 5—5 of FIG. 4.
Figure 4:
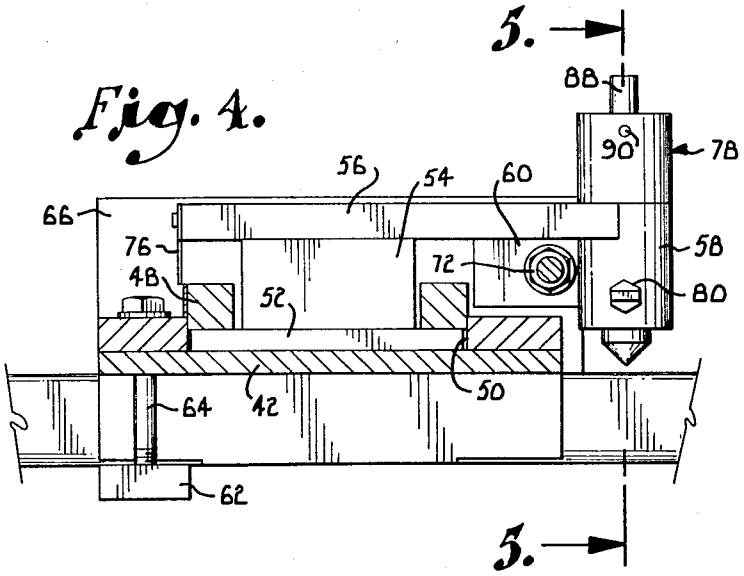
FIG. 4 is a vertical cross-sectional view taken along line 4—4 of FIG. 3.
Figure 3:
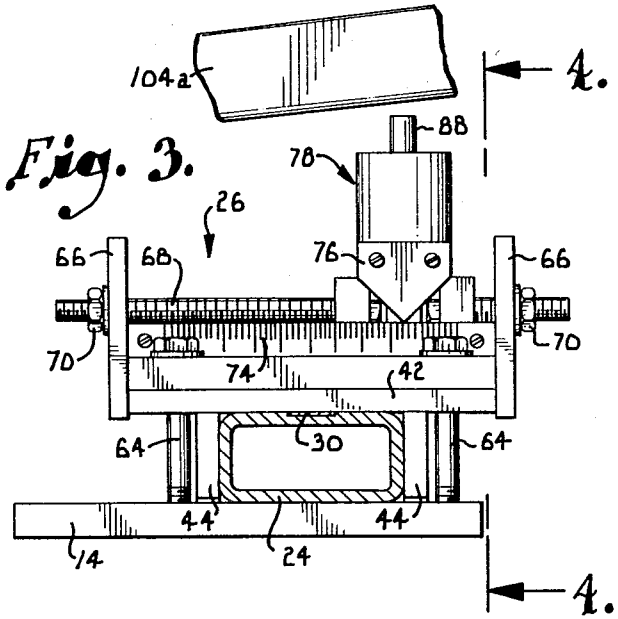
FIG. 3 is a vertical cross-sectional view taken along line 3—3 of FIG. 2.

Referring now to FIGS. 3–5, details of aligning fixture 26 are shown. The aligning fixture comprises a slidable bottom plate 42 that is adapted to ride along the top horizontal surface of beam 24. Extending downwardly from plate 42 are two perpendicular guide plates 44 disposed on opposite sides of and closely adjacent to beam 24. Rigidly coupled with plate 42 are side braces 46 which in turn rigidly mount elongated keepers 48 which cooperate with the side braces and bottom plate 42 to define a track 50. Track 50 slidingly receives a base plate 52. Rigid with base plate 52 and extending upwardly between keepers 48 is a stand block 54 which rigidly mounts a horizontally extending arm 56. Arm 56 in turn mounts a sleeve 58 to one side of bottom plate 42. Also rigid with arm 56 and sleeve 58 is a threaded drive block 60. The entire fixture 26 may be locked rigid with beam 24 through strap 62 extending beneath the beam and coupled with bottom plate 42 by nut and bolt assemblies 64.

Generally rectangular side plates 66 are rigid with bottom plate 42 and rotatably receive a drive screw 68 that is threadably received by drive block 60. Drive screw 68 is rotated by drive nuts 70 and locking nuts 72 on opposite sides of block 60 provide means for locking the drive block relative to screw 68. A ruler 74 is mounted on one of the keepers 48 and the relative position of arm 56 transversely of beam 24 is indicated by pointer 76 affixed to the end of arm 56.

As best illustrated in FIG. 5, sleeve 58 slidably receives stanchion 78 which is held in place by keeper pin 80. Stanchion 78 comprises a flat head pin 82 characterized by through appertures 84 that are disposed in vertically space-apart transverse relationship. The bottom end of the pin presents a pointer 82*a*. Seated on pin 82 is a collar 86 which in turn mounts a cylindrical head 88. Head 88 is held in place relative to the collar by a pin 90.

Figure 8:
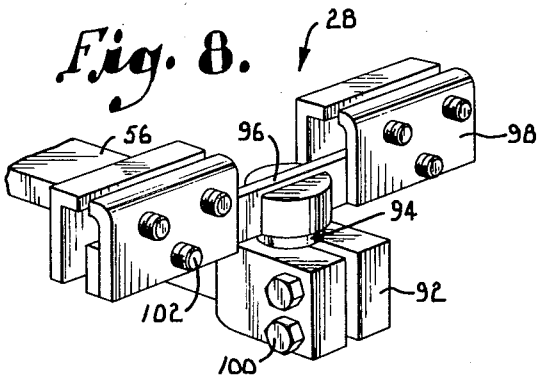
FIG. 8 is a perspective view of the clamping fixture of the invention.
Figure 6:
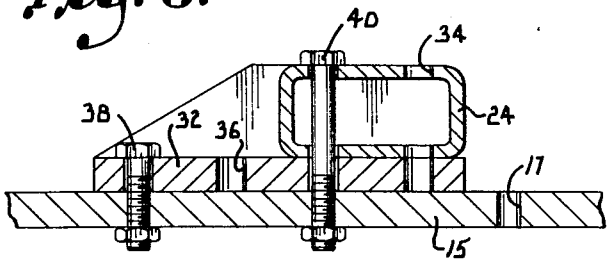
FIG. 6 is a vertical cross-sectional view taken along line 6—6 of FIG. 2.

Referring now to FIG. 8, clamping fixture 28 is shown in greater detail. Fixture 28 is identical in construction to fixture 26 except that arm 56 mounts a split sleeve 92 instead of sleeve 58. Split sleeve 92 receives a vertically removable stanchion 94 having a horizontal arm 96 which in turn mounts two jaw clamps 98. Bolts 100 are utilized to hold stanchion 94 in fixed relationship relative to sleeve 92. Bolts 102 clamp jaws 98 to the vehicle.

Figure 2:
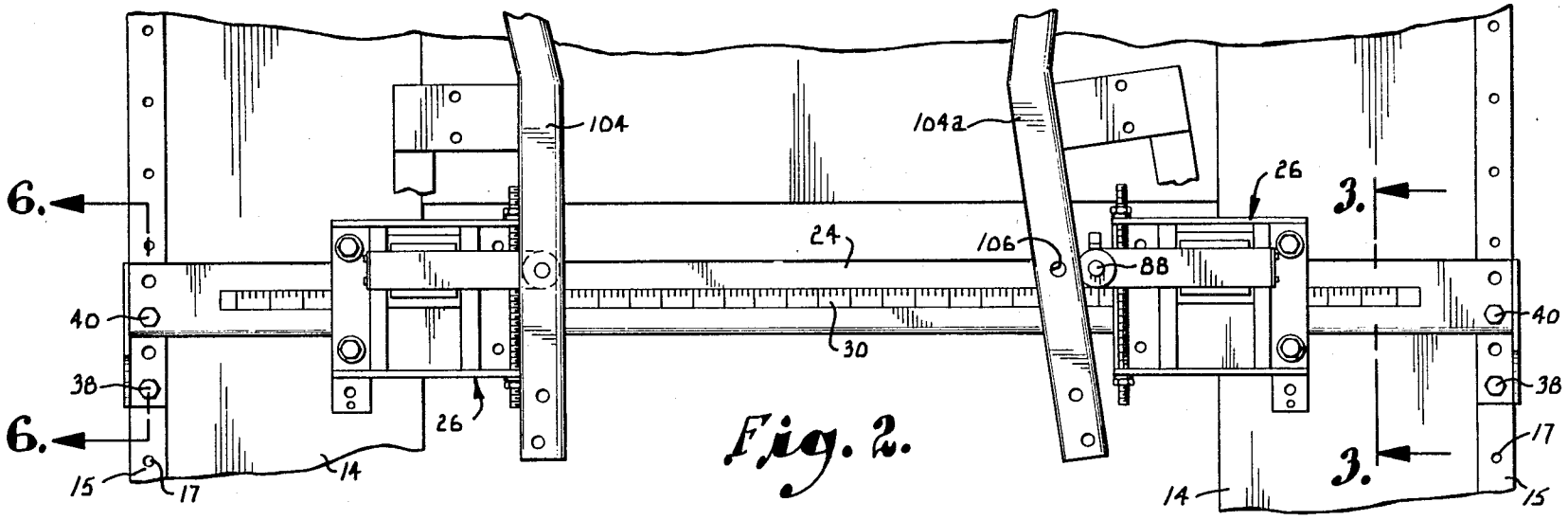
FIG. 2 is an enlarged top plan view of the aligning fixtures of the present invention.

Operation of the aligning system of the invention will be discussed with reference to a vehicle frame 104 illustrated in FIGS. 2 and 3. It is to be noted that for purposes of illustration a portion 104*a* of the frame is indicated as being out of alignment. It should also be understood that, in most cases where a vehicle is repairable, it will not be damaged in more than two of its four quarters. Accordingly, it is normal procedure to utilize the two "good" quarters as reference points for fixturing the remainder of the vehicle.

In this regard, beams 24 are positioned fore and aft along rack 10 in the approximate location where they will be utilized and locked in place by bolts 38 and 40. It is to be understood that clamping fixtures 28 may be positioned on either side of aligning fixtures 26, although in most instances the clamping fixtures will be located between the aligning fixtures and the center of the vehicle. Charts are provided for each model and make of vehicle sold indicating the location and size of fixturing holes in the vehicle frame. Such holes are designated by the numeral 106 in FIG. 2. Referring further to this FIG., the left aligning fixture 26 is moved along beam 24 transversely of vehicle frame 104 until head 88 is in transverse alignment with the proper fixturing hole. It should be understood that stanchion 78 has been preselected to provide a pin 82 and head 88 of the appropriate height and diameter, respectively. Different length pins having different heads would normally be provided. The transverse position of stanchion 78 relative to beam 24 is indicated by pointer 82*a* and ruler 30 (FIG. 5).

Once head 88 is in transverse alignment with a vertical fore and aft plane passing through aligning hole 106, the final fore and aft alignment is achieved by turning screw 68. Once this final alignment is achieved, nuts 72 are tightened to lock arm 56 relative to the bottom plate 42. The exact fore and aft position of head 88 relative to bottom plate 42 is indicated by pointer 76 and ruler 74.

Figure 7:
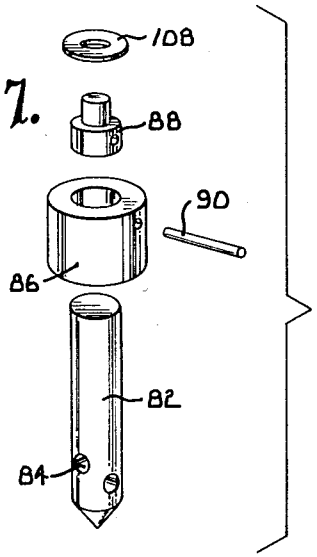
FIG. 7 is an exploded view of the vertical stanchion which forms a part of the aligning fixture.

It is to be noted that through apertures 84 in pin 82 are spaced vertically one-half inch apart thus providing a height variable of this distance for any given pin. Furthermore, additional height adjustment is provided by washer 108 (FIG. 7) adapted to be received by head 88. Washer 108 is one-eighth inch in thickness and two washers may be utilized to provide a height adjustment of up to one-quarter inch or half the distance between through apertures 84.

The readings from rulers 30 and 74 as indicated by pointers 82*a* and 76, respectively, are then utilized to position the right-hand aligning fixture 26. Once the fixtures are in their proper positions, bolts 64 are tightened to hold the fixtures in place relative to beam 24. Clamping fixtures 28 are then moved into position to grab frame 104 in generally the same manner as discussed for aligning fixtures 26. It is to be understood, of course, that a clamping fixture would not normally be utilized in the area of damaged frame portion 104. Also, precise alignment of the clamping fixtures is not required and, accordingly, rulers 30 and 74 along with the associated pointers could be deleted from the clamping fixtures and their associated beams 24. Once all of the fixtures and beams are locked in place, damaged frame portion 104*a* is pulled to straighten it out. In this regard, an important aspect of the present invention is that fixtures 26 and 28 are built so that they will remain engaged with the frame during the pulling operation without any damage to the fixture. The frame is pulled until fixturing hole 106 in the damaged portion 104*a* is brought into alignment with head 88 on the right-hand aligning fixture 26. The procedure may be repeated at other fixturing points along frame 104 as required to complete alignment of the damaged frame.

The system of the present invention offers considerable advantages over prior art constructions and for the first time provides a truly universal dedicated fixturing system that is capable of withstanding the pulling forces exerted by modern frame straightening machines. It is also simple to operate and relatively economical to construct.

I claim:

1. A fixture assembly for use in conjunction with a vehicle frame straightening rack and a movable elongated beam adapted to be coupled to both said vehicle and said rack during the straightening operation, said vehicle frame being characterized by a series of alignment openings, said fixture assembly comprising:

flat plate means spanning said beam;

releasable means for locking said flat plate to said beam and for accommodating sliding movement of said flat plate relative to said beam;

first and second guide plates rigid with said flat plate means and extending downwardly from the latter on opposite sides of and in close proximity to said beam;

first and second elongated side braces rigidly coupled with said flat plate means in parallel spaced apart relationship;

first and second elongated keepers rigidly coupled with said first and second side braces and cooperating with the latter to present a closed track;

base plate means slidably received by said track means and held against vertical displacement by said keepers;

arm means rigidly coupled with said base plate means;

sleeve means rigid with one end of said arm means means for locking said base plate means against movement relative to said flat plate means; and stanchion means releasably received by said sleeve for rigidly engaging said vehicle framd; and means for holding said stanchion means rigid relative to said sleeve, whereby when a straightening force is applied to a portion of said vehicle frame that portion of said vehicle frame engaged by the stanchion means will be held stationary.

2. A fixture assembly as set forth in claim 1, wherein said stanchion means includes a head adapted to be received in an opening in said vehicle frame and wherein is included means for varying the size of said head.

3. The invention of claim 1, wherein is included means for locking said stanchion means at a plurality of vertical heights.

4. The invention of claim 1, wherein said means for locking said arm means to said base plate means comprises rotatable screw means which also effects movement of said base plate relative to said track.

* * * * *